United States Patent [19]

Haaheim

[11] Patent Number: 4,618,139

[45] **Date of Patent: * Oct. 21, 1986**

[54] EXERCISE MACHINE

[76] Inventor: Gary R. Haaheim, 112712 Hundertmark Rd., Chaska, Minn. 55318

[ * ] Notice: The portion of the term of this patent subsequent to Jul. 16, 2002 has been disclaimed.

[21] Appl. No.: 684,616

[22] Filed: Dec. 21, 1984

[51] Int. Cl.[4] ..... A63B 1/00; A63B 69/18; A63B 21/00

[52] U.S. Cl. ..... 272/70; 272/97; 272/132; 272/69; 272/126

[58] Field of Search ..... 272/131, 132, 97, 69, 272/120, 121, 126, 93, 70

[56] References Cited

U.S. PATENT DOCUMENTS

| | | | |
|---|---|---|---|
| 1,982,843 | 12/1934 | Traver | 272/70 |
| 2,921,791 | 1/1960 | Berne | 272/132 |
| 3,582,069 | 6/1971 | Flick | 272/126 |
| 4,023,795 | 5/1977 | Pauls . | |
| 4,402,506 | 9/1983 | Jones . | |
| 4,434,981 | 3/1984 | Norton . | |
| 4,512,571 | 4/1985 | Hermelin | 272/126 |
| 4,529,194 | 7/1985 | Haaheim | 272/132 |

*Primary Examiner*—Richard J. Apley
*Assistant Examiner*—S. R. Crow
*Attorney, Agent, or Firm*—Paul L. Sjoquist

[57] ABSTRACT

An exercise machine for providing simultaneous exercise of arms and legs against controlled frictional resistances, including a pair of wheeled trucks adapted for rolling along predetermined longitudinal tracks, the trucks being interconnected through a cable loop which also passes about an adjustable friction clutch, and a pair of generally upstanding bars for hand grasping, each of the bars pivotal about pins mounted in respective adjustable friction clutches at approximately the same height as the trucks. All of the components of the machine are mounted on a single frame assembly, having a pair of transport wheels on one end and a handle bar on the other end.

20 Claims, 7 Drawing Figures

Fig. 1
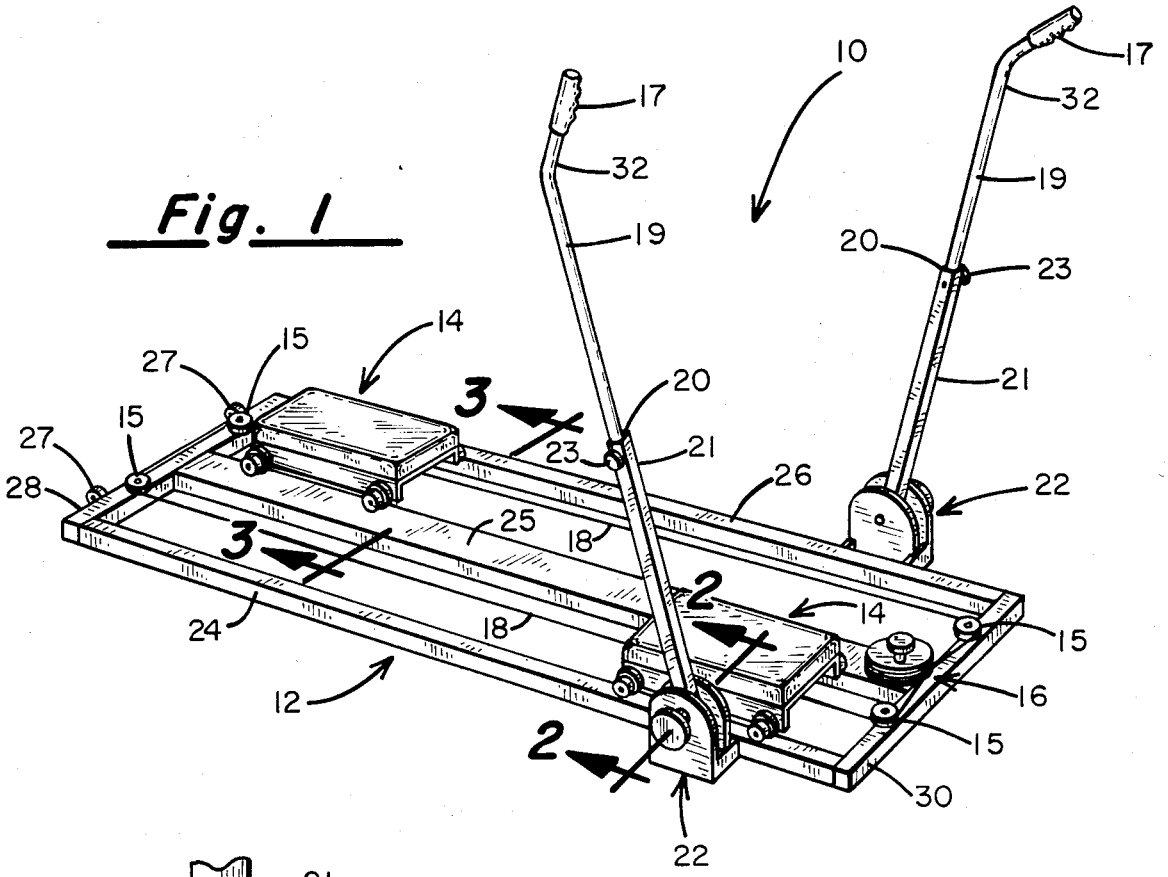
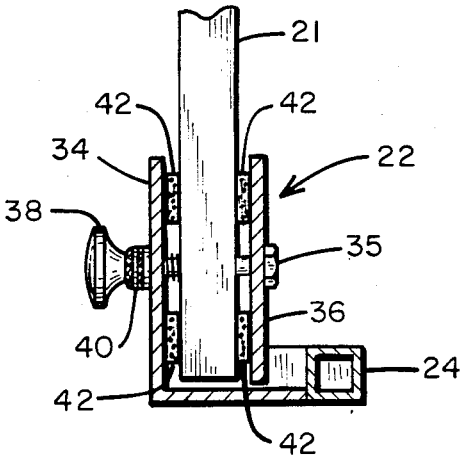
Fig. 2
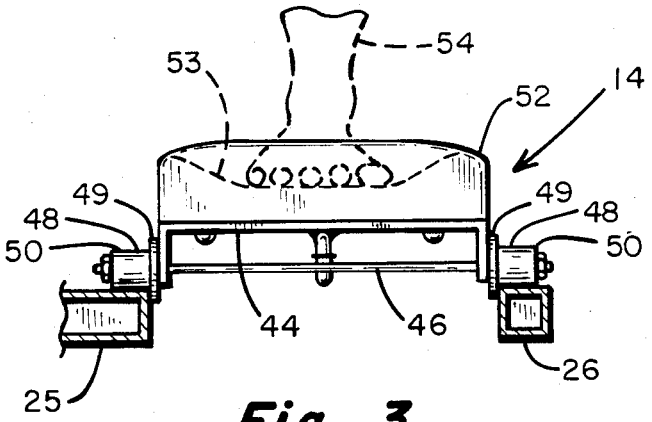
Fig. 3

EXERCISE MACHINE

BACKGROUND OF THE INVENTION

The present invention relates to exercise machines, and more particularly to machines for simultaneously exercising both arms and both legs in a natural rhythmic skiing motion, wherein the level of exercise may be controlled through frictional clutches which selectively provide resistance to arm and leg motion.

Certain devices in the prior art provide the ability to exercise with motion effects similar to the present invention, but suffer from various disadvantages which are overcome in the present invention. For example, U.S. Pat. No. 4,023,795, issued May 17, 1977, discloses a ski exerciser for simulating the motions required in cross country skiing. The system employs a complicated arrangement of a fly wheel with an engageable brake band and roller assemblies on either side of the fly wheel, each assembly including a one-way clutch, and the system operates in conjunction with cross-country skis which are mountable thereon. U.S. Pat. No. 4,402,506, issued Sept. 6, 1983 discloses a pair of dollies which are slidably moveable along two guide ways, and are adapted for standing, and in conjunction therewith the operator utilizes two poles for balance and for simulating a skiing motion. U.S. Pat. No. 4,433,981, issued Mar. 6, 1984 discloses a pair of slidable dollies in guide channels, in combination with a pair of simulated ski poles which also are constrained in guide channels so as to simulate the sliding motion which occurs during skiing. United Kingdom Patent Publication No. 2,007,987 discloses a pair of footrests mounted on tracks and interconnected by cords for simultaneous motion in opposite directions, and includes a hand support lever which may be connected by a link to one of the footrests for simultaneous reciprocation therewith, which forces a motion contrary to natural body reflex motion.

All of these patents provide a limited degree of exercise for the legs, particularly in simulation of skiing motions, and several of the patents disclose concurrent arm exercising mechanisms. However, none of patents disclose a simple device wherein the friction of resistance to motion may be carefully controlled and independently adjustable as to each arm movement, and further independently adjustable as to leg movement. Further, none of the prior art devices are easily adaptable for transportable mounting on a single frame assembly, and for storage as a relatively flat one piece assembly.

Further, the present invention provides an exercise mechanism which requires the user to work against a constant force, which is infinitely adjustable from a free wheeling force to an irresistible force. The arm motion exerciser provides independent adjustment for exercising each arm, and requires that the arm both push and pull against a constant force. The leg exerciser provides a continuously adjustable resistance to both forward and rearward leg motion. Because of the location of the respective arm exercising levers, and the interconnecting trucks for exercising the legs, the entire apparatus provides an exercise machine which not only guides the operator through a natural motion cycle, but also provides stable supporting members to assist the operator in controlling his exercise motion. Moreover, there is no physical attachment required between the operator and the machine, and thereby the operator may readily mount and dismount from the machine without any connections to the body, and the chance of injury which might otherwise be caused by fastening devices is eliminated.

SUMMARY OF THE INVENTION

The invention includes a frame which is adapted for lying flat on a floor, the frame having at least three parallel rails for guiding a pair of wheel mounted trucks. The frame also has transverse end members, one of which has mounted thereon a pair of wheels for transporting the device. An adjustable friction clutch assembly is mounted to each of the outside rails, and a pivotable handle is attached thereto. The lower sections of each of the pivotable handles are preferably made of square or rectangular cross sectional tubular material, and the lower handle sections are each pivotable between two plates, and friction pads are mounted intermediate each plate and the respective handle section surfaces.

The wheel mounted trucks are moveably mounted between respective rail pairs, and each truck is affixed to an endless loop cable which is mounted via frame-attached pulleys to guide the trucks over respective parallel tracks along the rails. The cable is also attached to a frame-mounted pulley having an adjustable friction clutch formed as a part thereof, wherein the cable may be wound and unwound about the pulley under variable friction conditions. A tension spring is attached to at least one terminus connection between the cable and at least one of the trucks.

It is a principal object of the present invention to provide an exercise device by creating a selective and controllable resistance to motion in two directions by movable members which may be moved by the arms and legs of the user.

It is another object of the invention to provide an exercise device for simultaneously exercising both arms and both legs of the user under controlled conditions.

It is another object of the invention to provide an exercise device wherein leg movement may be selectively restrained in a sliding motion by wheeled trucks coupled to a frictional clutch assembly.

It is another object of the invention to provide independently controllable members for selectively exercising each arm, with pivotal members which may be frictionally adjusted.

BRIEF DESCRIPTION OF THE DRAWINGS

The foregoing and other objects and advantages of the invention will become apparent from the following specifications and claims, and with reference to the appended drawings, in which:

FIG. 1 shows a perspective view of the invention;

FIG. 2 shows a cross sectional view taken along the lines 2—2 of FIG. 1;

FIG. 3 shows a cross sectional view taken along the lines 3—3 of FIG. 1;

DESCRIPTION OF THE PREFERRED EMBODIMENT

Figure 4:
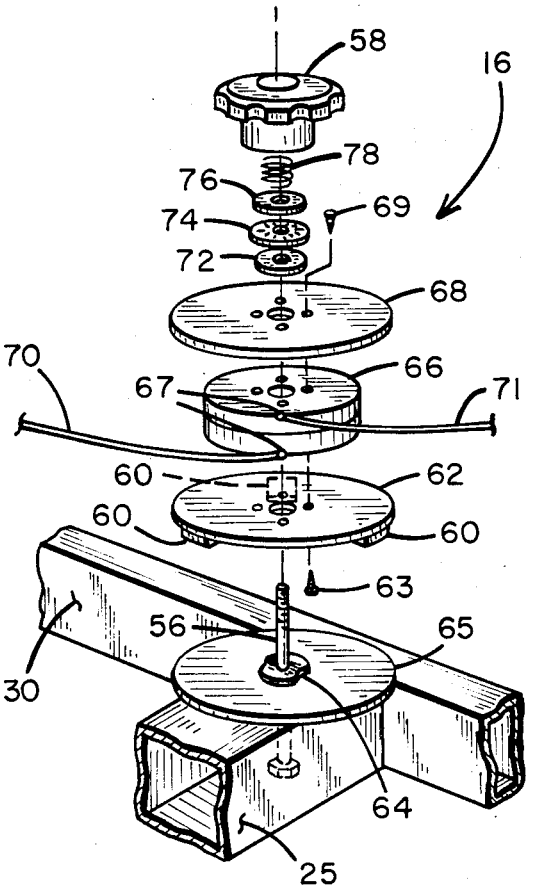
FIG. 4 shows an exploded view of the cable clutch mechanism.

Referring first to FIG. 1, exercise machine 10 is shown in perspective view. A frame assembly 12 is adapted for resting on a flat floor surface, and for providing a stable mounting base for the components to be hereinafter described. A pair of wheeled trucks 14 are mounted to roll on the frame assembly 12 as will be described in more detail hereinafter. The trucks are connected together via an elongated cable 18 which is guided by pulleys 15 and terminates at a friction cable clutch 16. A pair of elongated handles 20 are pivotally attached to frame 12 by respective frictional clutch assemblies 22.

Frame assembly 12 includes three parallel rails 24, 25 and 26. Each of these rails is preferably constructed of square or rectangular cross sectioned tubular steel, having respectively upwardly flat surfaces. Rail 25 is preferably at least twice as wide as rails 24 and 26, for supporting the inner wheel pairs of both trucks 14. An end member 28 is affixed to each of the rails 24, 25 and 26 as by welding or equivalent attachment. A further end member 30 is similarly attached to the other ends of rails 24, 25 and 26.

Each of the handles 20 is preferably constructed of a square cross section lower member 21 and a round cross section upper member 19 which is telescopically fitted within lower member 21. A latch pin 23 or similar device permits upper member 19 to be locked into lower member 21, and a plurality of holes may be provided through either or both members for providing selective positioning of upper member 19 within lower member 21. A hand grip 17 is provided on the uppermost end of upper member 19 for conveniently gripping by a user. Upper member 19 is forwardly curved at 32, to provide an approximately vertical position of hand grip 17 when handle 20 is pivoted to its rear most operating position, as is shown in FIG. 1.

The lower member 21 of handle 20 is pivotally attached between plates 34 and 36 proximate its end, as is best shown in FIG. 2. A bolt 35, or similar fastener, passes through plates 34 and 36, and also passes through an opening in handle member 21. A knob 38 is threadably attached to bolt 35, and a thrust bearing 40 is clamped between knob 38 and plate 34. Friction pads 42 are preferably affixed to tubular member 21 and are clamped intermediate tubular member 21 and plates 34 and 35 respectively. Friction pads 42 are made from a composite, non-asbestos material sold under the name ScanPac, by a division of Johns Manville Corporation, or equivalent material, to provide a frictional bearing surface intermediate tubular member 21 and plates 34 and 36. Clutch assembly 22 is attached to rail 24 by welding, and a construction of the corresponding clutch assembly attached to rail 26 is of identical design.

FIG. 3 shows a cross section view taken along the lines 3—3 of FIG. 1, primarily illustrating an end view of one of the trucks 14. Truck 14 is formed of an inverted channel frame 44, which has four wheels 48 attached thereto via axles 46. Each of the wheels 48 has an inner raised flange 49 and an outer flat surface 50 for engaging against a rail. The wheels 48 are mounted outboard of the frame 44, thereby providing increased stability to truck 14. Further, raised flange 49 provides stability against lateral movement and flat surface 50 provides a smooth rolling surface to engage against the respective rails. A foot pad or cushion 52 is affixed across the top of frame 44 to provide a comfortable and stable support for the user's foot 54. Cushion 52 is made from a soft resilient material so as to provide a pocket 53 about foot 54 whenever the user stands on cushion 52. Pocket 53 tends to contain foot 54 within cushion 52 to prevent foot 54 from slipping out of contact with cushion 52.

FIG. 4 shows a exploded view of friction cable clutch 16, which comprises a number of components affixed together along an axis of bolt 56. The projecting end of bolt 56 is threadably attached to a knob 58, which may be selectively drawn to clamp the respective components together. One or more friction pads 60 are affixed to the underside of disk 62, so as to engage against the upper surface of disk 65. A spring washer 64 is fitted over bolt 56 above disk 65 so as to provide an upwardly urging spring force tending to separate disk 65 from contact with friction pads 60. Disk 65 is affixed to frame members 30 and 25, and provides heat dissipation of the frictional heat developed by the friction pads 60.

Disk 62 is fixedly attached to the lower side of cable pulley 66, and disk 68 is fixedly attached to the upper side of cable pulley 66, as by fasteners 63 and 69 respectively. Cable pulley 66 has openings 67 therein for accepting cable segments 70 and 71, which form a part of cable 18 referred to hereinbefore. Cable segments 70 aand 71 are typically wrapped around pulley 66 from opposite directions for at least several full circumferences of pulley 66, so as to permit the necessary freedom of movement for trucks 14. A washer 72 is positioned immediately above disk 68, and a thrust bearing 74 is contained between washer 72 and an upper washer 76. Finally, a compression spring 78 is contained between knob 58 and washer 76.

Figure 5:
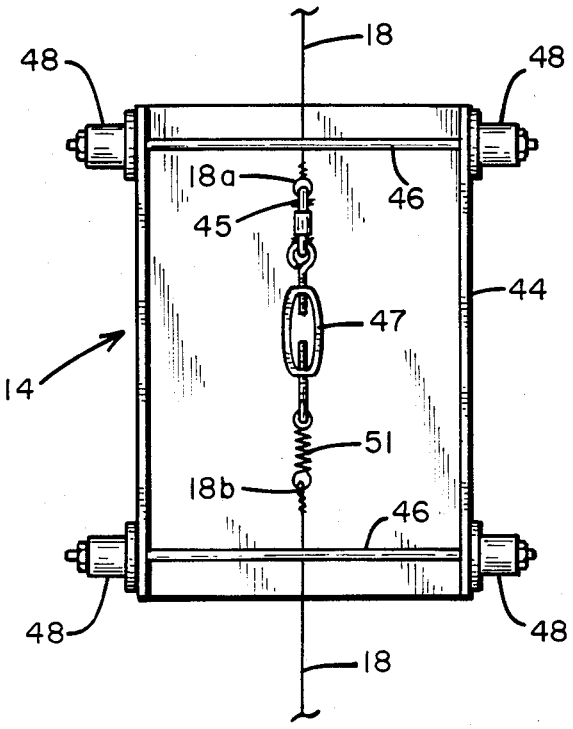
FIG. 5 shows a bottom view of one of the wheeled trucks.

FIG. 5 shows a bottom view of one of the trucks 14. Two pairs of wheels 48 are mounted on axles 46 which pass through openings in the side wall of frame 44. A metal loop 45 is attached by a weldment to the undersurface of frame 44, and end **18*a* of cable 18 is looped around and secured to metal loop 45. A turnbuckle 47 is also looped about and affixed to metal loop 45 at one of its ends, to the other end of turnbuckle 47 being secured to a tension spring 51. The other end of tension spring 51 is affixed to cable 18 at loop 18*b***.

Figure 6:
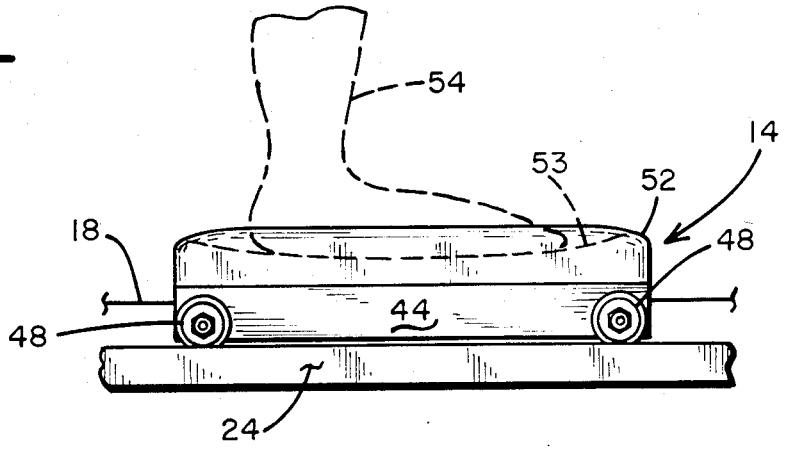
FIG. 6 shows a side view of a wheeled truck in operation.

FIG. 6 shows a side view of a truck 14 with a foot 54 standing on cushion 52, to illustrate the pocket 53 which is formed by the depression caused by the weight of the person standing on the trucks.

Figure 7:
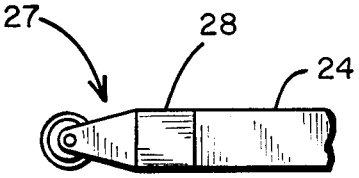
FIG. 7 shows a partial side view of the frame assembly.

FIG. 7 shows a partial side view of frame 24, and end view of frame 28. A pair of casters 27 are affixed to the outside of frame 28 as shown in FIG. 7, with respect to one of the casters 27. Casters 27 allow the entire exercise machine 10 to be picked up from the opposite end and rolled along a floor surface for transport, but are disengaged from contact when the machine is in operable use.

In operation, the user places his feet in the cushions on top trucks 14, and grasps the hand grips 17, one in each hand. The feet are then moved in a back and forth sliding motion, while being constrained in the cushions of trucks 14, while at the same time handles 20 are pivoted about clutch assemblies 22. To increase or decrease the amount of work required for sliding truck 14 along the tracks, friction cable clutch 16 may be selectively loosened or tightened to provide more or less resistance to the motion of trucks 14. Similarly, the knobs affixed to the clutch assemblies 22 may be each selectively loosened or tightened to provide more or less resistance to the movement of handles 20. In exercising with the machine as summarized above, the user finds that the friction to arm motion is constant in both directions, and does not suffer from fluctuations in resistance force depending upon handle position. Further, the tension spring attached to at least one of the trucks 14 provides a certain degree of shock absorption which prevents an initial jerking motion which might otherwise occur when attempting to start the exercise operation.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An exercise machine for providing simultaneous exercise of arms and legs against adjustable frictional resistances, comprising (a) a frame assembly having at least three parallel rails and having end members affixing said rails in spaced relationship;

(b) a pair of wheeled trucks, each of said trucks mounted between two parallel rails with each wheel on a rail for free rolling thereon;

(c) a plurality of rotatable pulleys attached to said frame assembly, each pulley being positioned proximate an end member, and a cable respectively attached to each of said trucks and guided by said pulleys;

(d) a first frictional clutch assembly attached on said frame assembly and attached to respective ends of said cable; and (e) a pair of elongated handles, each pivotally mounted between a pair of plate members, at least one of said plate members being affixed to said frame assembly, and friction pads mounted intermediate said plate members and said handles, including means for selectively clamping said plate members against said friction pads and said handles.

2. The apparatus of claim 1, wherein said first frictional clutch assembly further comprises at least one friction pad; a first plate adjacent to said at least one friction pad; a cable pulley affixed to said first plate, said pulley having means for attachment to said cable; a second plate affixed to said cable pulley on a side opposite said first plate; a third plate attached to said frame assembly beneath said at least one friction pad; threaded attachment means passing through said frame assembly, said plates and said pulley; and means for threadably clamping said first and second plates and said pulley toward said third plate.

3. The apparatus of claim 2, further comprising a first compression spring member between said third plate and said first plate, and a second compression spring member between said means for threadably clamping and said second plate.

4. The apparatus of claim 3, further comprising a thrust bearing intermediate said means for threadably clamping and said second plate.

5. The apparatus of claim 1, wherein each of said trucks further comprise an inverted U-channel frame, and two pairs of axle-mounted wheels, and each of said wheels comprise an enlarged diameter flange and a reduced diameter roller.

6. The apparatus of claim 5, further comprising, on at least one of said trucks, a cable attachment including a resilient tension spring intermediate said cable and said truck.

7. The apparatus of claim 5, further comprising a threaded turnbuckle attached in series relationship between said cable and at least one of said trucks.

8. The apparatus of claim 5, wherein each of said trucks further comprises a resilient cushion over an upper surface of said U-channel frame, said cushion being deformable and compressible under the weight of a person standing thereon.

9. The apparatus of claim 1, wherein said elongated handles each further comprise at least two telescoping handle sections.

10. The apparatus of claim 9, wherein one of said handle sections comprises a square cross section tubular member pivotally mounted between said plate members, and the other of said handle sections comprise a round cross section tubular member sized for fitting inside said square tubular member.

11. The apparatus of claim 10, further comprising means for selectively positioning said round tubular member within said square tubular member.

12. The apparatus of claim 1, further comprising a pair of roller casters attached to one of said frame assembly end members.

13. The apparatus of claim 4, wherein each of said trucks further comprise an inverted U-channel frame, and two pairs of axle-mounted wheels, and each of said wheels comprise an enlarged diameter flange and a reduced diameter roller.

14. The apparatus of claim 13, further comprising, on at least one of said trucks, a cable attachment including a resilient tension spring intermediate said cable and said truck.

15. The apparatus of claim 14, further comprising a threaded turnbuckle attached in series relationship between said cable and at least one of said trucks.

16. The apparatus of claim 15, wherein each of said trucks further comprises a resilient cushion over an upper surfaces of said U-channel frame, said cushion being deformable and compressible under the weight of a person standing thereon.

17. The apparatus of claim 16, wherein said elongated handles each further comprise at least two telescoping handle sections.

18. The apparatus of claim 17, wherein one of said handle sections comprises a square cross section tubular member pivotally mounted between said plate members, and the other of said handle sections comprise a round cross section tubular member sized for fitting inside said square tubular member.

19. The apparatus of claim 18, further comprising means for selectively positioning said round tubular member within said square tubular member.

20. The apparatus of claim 19, further comprising a pair of roller casters attached to one of said frame assembly end members.

* * * * *